United States Patent [19]

Emery

[11] Patent Number: 5,014,860

[45] Date of Patent: May 14, 1991

[54] SHOWER CADDY

[75] Inventor: William W. Emery, Berkeley Heights, N.J.

[73] Assignee: Better Sleep Manufacturing Co., Berkeley Heights, N.J.

[21] Appl. No.: 388,236

[22] Filed: Aug. 1, 1989

[51] Int. Cl.[5] ..... A47F 5/00

[52] U.S. Cl. ..... 211/106; 211/88; D6/525; 248/206.3

[58] Field of Search ..... 211/106, 88, 87, 90, 211/119; D6/525, 537, 540; 248/205.5, 206.3, 206.4

[56] References Cited

U.S. PATENT DOCUMENTS

| | | | |
|---|---|---|---|
| D. 194,307 | 1/1963 | Raphael | D6/525 |
| D. 251,522 | 4/1979 | Chapman | D6/525 |
| 1,325,143 | 12/1919 | Conterio | 248/206.4 X |
| 1,483,640 | 2/1924 | Manning | 248/206.3 |
| 2,230,037 | 1/1941 | Hoeflich | 211/106 X |
| 2,672,988 | 3/1954 | Johnson | 211/106 X |
| 3,789,996 | 2/1974 | Stroh | 211/119 |
| 4,708,310 | 11/1987 | Smith | 211/90 X |

*Primary Examiner*—Robert W. Gibson, Jr.
*Attorney, Agent, or Firm*—Hopgood, Calimafde

[57] ABSTRACT

The invention is directed to a bath caddy mountable by means of suction cups on a non-porous surface which is positionally adjustable in four directions and has a frame including a horizontal element, a plurality of members attached perpendicularly thereto and a horizontal bar attached thereto and a horizontal bar attached to such members having each end open to receive slidably mounted suction cups.

15 Claims, 2 Drawing Sheets

SHOWER CADDY

BACKGROUND OF THE INVENTION

Shower caddies have evolved over the past decade or two, with increasing popularity. Traditionally, they are a device that hangs on the shower arm, that is the pipe that comes out from the wall which holds the shower head. This has restricted the bather to one location, which in many cases is not convenient because of the location of the faucets, built-in soap dishes, location of shower arm, bather's height, disabilities of the bather, items to be stored—especially tall containers, as well as type and construction of the bathroom wall. There have been attempts to stabilize the caddies since an uneven load may induce the caddy to swing and cause items to fall. Next came the corner caddy, held in place with double-faced pressure sensitive tape. This restricted the caddy to the corner. Since it was affixed to the wall with adhesive, it was difficult to adjust, move or remove for cleaning. The tape either held so well the caddy was damaged when trying to remove, or the tape failed and the caddy repeatedly fell.

Today's families have many bathing accessories that are brought into the shower and tub area. Extensive advertising has created families where each member has his/her own shampoo, hair conditioner, body and/or facial soap, body lotions and softeners, body brush, nail brush, loofas, sponges, pumice stick, foot file, razor, shaving cream, shaving brush, toothbrushes, etc. This has created a desire for larger caddies, as well as the need for more than one caddy.

The invention leaves the bather free to position a caddy where it is best for him, i.e., the bather is not locked into placing the caddy in a corner or hanging it from the shower arm.

BRIEF DESCRIPTION OF THE INVENTION

In accordance with the invention a bath caddy is provided which is mountable by means of suction cups on any non-porous surface, such as a glazed tile, and is positionally adjustable in four directions comprising a frame having a horizontal element, a plurality of members attached perpendicularly to the horizontal element and a horizontal bar attached to said members having each end thereof open to receive slidably mounted suction cups thereon. The frame may be bent into a plurality of shapes to form, e.g., a corner shelf with an open work bottom and provided with a gallery, a support for a rectangular shelf with auxiliary soap dish, a U-shaped magazine or book rack for contemplative reading, etc.

DETAILED DESCRIPTION OF THE INVENTION

Figure 1:
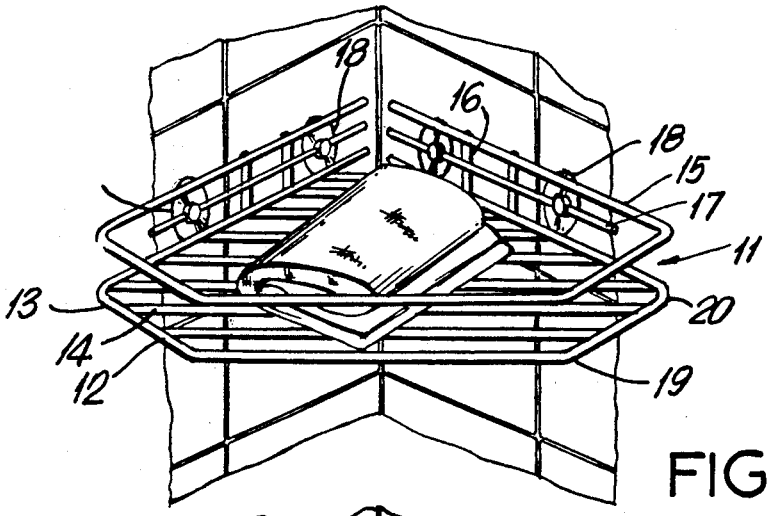
FIG. 1 illustrates an adjustable corner caddy in accordance with the invention.

The invention will now be described in connection with the drawing which, in FIG. 1, depicts a corner shelf 11 having a shelf member 12 made of a wire frame 13 bent into substantially the shape of a right triangle with open ends at the 90° apex and with parallel connecting or cross members 14 fastened to the frame at each end in a direction perpendicular to a line bisecting the 90° angle so as to form an openwork bottom in the shelf. Shelf 12 is provided with a congruent or complementary gallery 15 having the same shape and size as frame 13 and fastened to frame 13 by vertical members 16 which rigidly join parallel and horizontal arms of gallery 15 and frame 13. Attached to members 16 is a horizontal bar 17 open at each end and adaptable to receive suction cups 18. As shown, two horizontal bars 17 are positioned vertically to find secure, smooth surface mounting in the wall corner avoiding cracks, joints, grout, etc. and the individual suction cups 18 may be located horizontally to obtain secure mounting. Four-way directional adjustability is thus achieved. The acute angles of the shelf frame 13 and gallery 15 are formed in two bends as shown at 19 and 20. The frame element opposite the 90° angle may be given any desired shape and may, for example, be arcuate.

Figure 2:
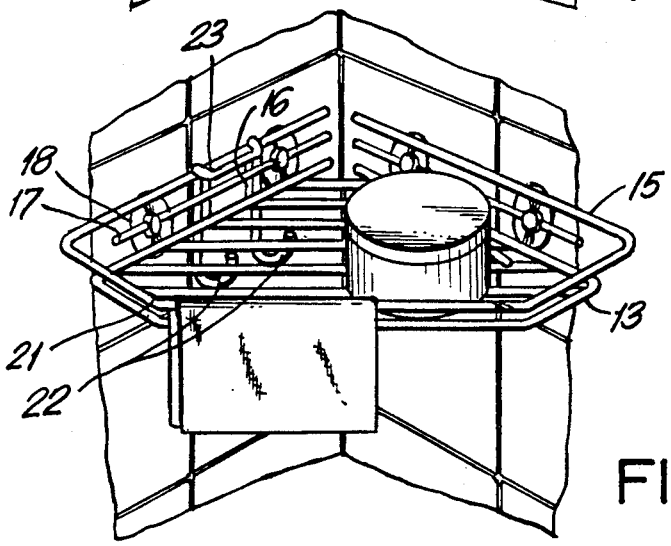
FIG. 2 illustrates a further corner caddy embodiment having an extended gallery forming a drying rack.

FIG. 2 of the drawing shows a corner shelf similar to that of FIG. 1 but with the gallery 15 being extended beyond the shelf frame 13 and subtending a larger area than the gallery of FIG. 1 to form a drying rack as shown at 21.

The devices of FIGS. 1 and 2 can be marketed together to provide a substantial area of safe storage space with the shelves being positioned at any desired height and distances apart to accommodate bath articles of various sizes. As shown, hooks 22 may be provided using a bent wire device 23 hooked over gallery 15. Alternatively, vertical members 16 may be extended downward and hooks 22 may be formed on the extended ends thereof. Again, suction caps 18 are slidably mounted on horizontal bar 17.

Figure 3:
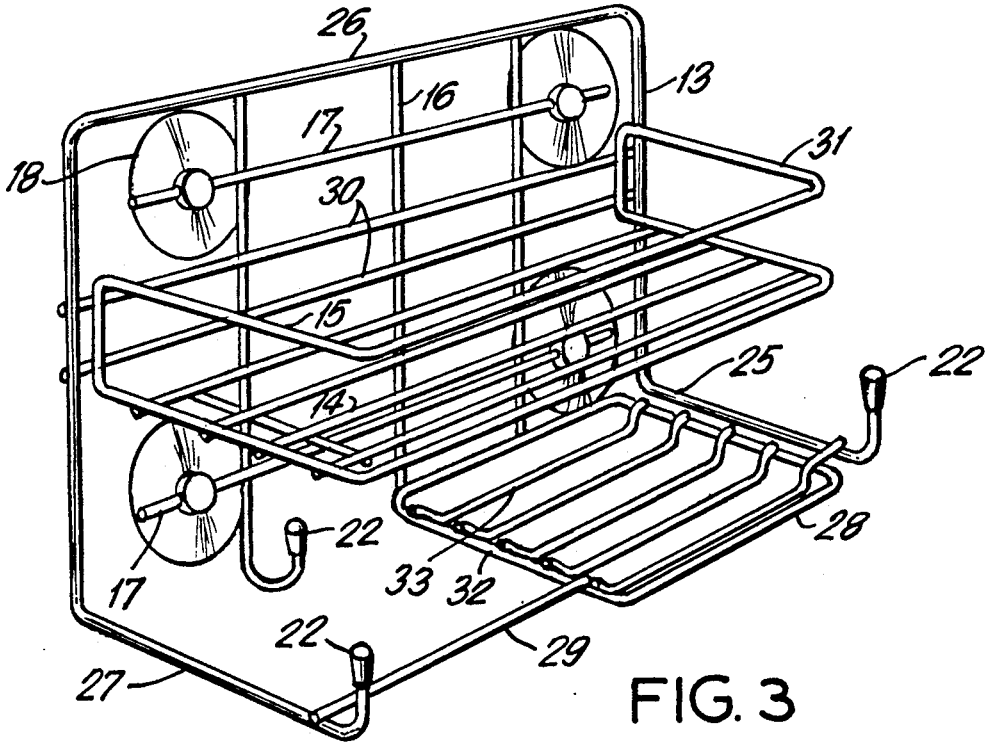
FIG. 3 illustrates a caddy having a galleried shelf, soap dish and hooks adaptable to wall mounting.

FIG. 3 of the drawing illustrates another configuration of the wall mountable device provided in accordance with the invention. In this device designated generally by reference character 25, wire frame 13 has a horizontal element 26 to which vertical members 16 are joined. Two horizontal bars 17 having free ends are fastened to vertical members 16 and hold slidably mountable suction cups 18 thereon. In this configuration, the suction cups 18 are mounted one above the other rather than in one horizontal plane as shown in the devices of FIGS. 1 and 2.

As shown, frame 13 is bent downward to form downwardly extending portions and then outwardly to form outwardly extending arms 27 perpendicular to said downwardly extending portions which hold soap dish 28 and rack member 29. Hooks 22 may be provided at the ends of frame 13 and at the bottom of a vertical member 16. In this embodiment, horizontal members 30 form a grid structure with the downwardly extending portions of frame 13 and vertical members 16 upon which shelf member 31 formed of wire to provide a gallery 15 and an openwork bottom by means of transversely extending wires 14. Soap dish 28 is formed of frame 32 and transversely extending wires 33 which are depressed below the plane of from 32 to hold the soap.

The device is adaptable for mounting on any non-porous surface, and again the horizontal and individual adjustability of the suction cups enables location on a sound surface. Storage of a multiplicity of items is facilitated and the device can be located to suit the convenience of the user.

Figure 4:
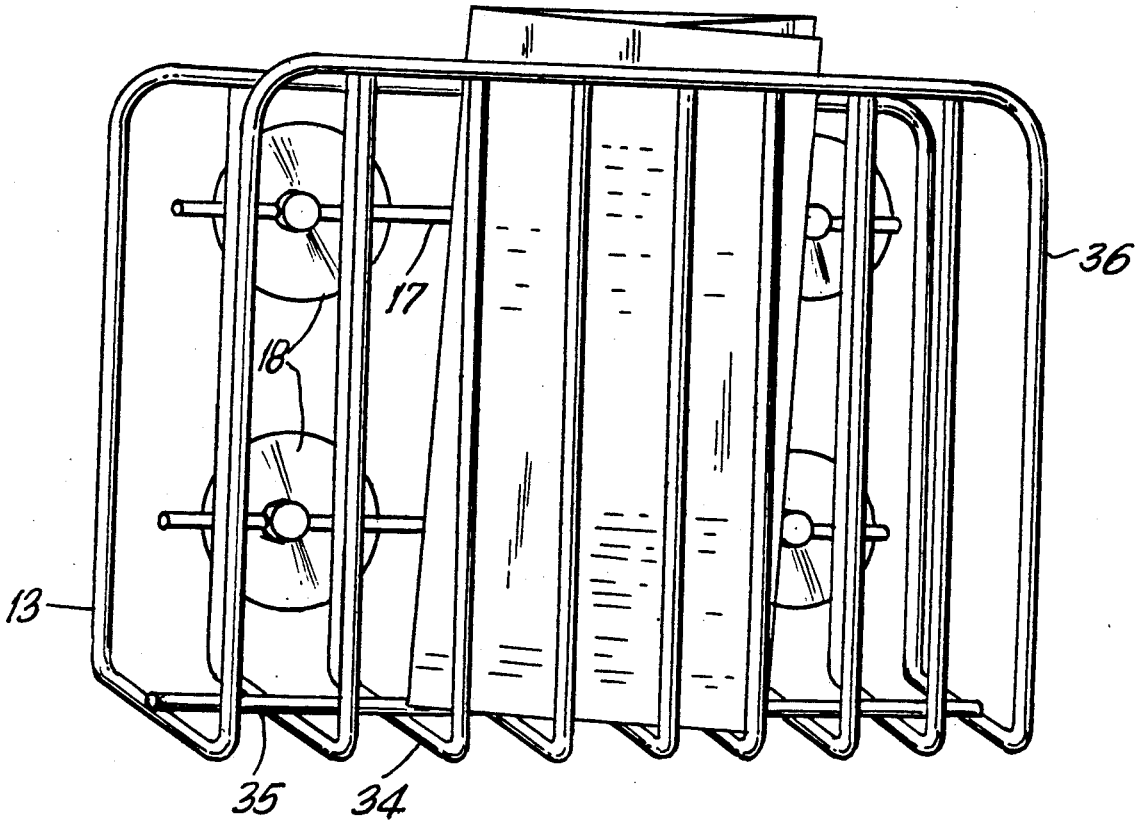
FIG. 4 illustrates a U-shaped magazine rack wall mountable in accordance with the invention.
Figure 5:
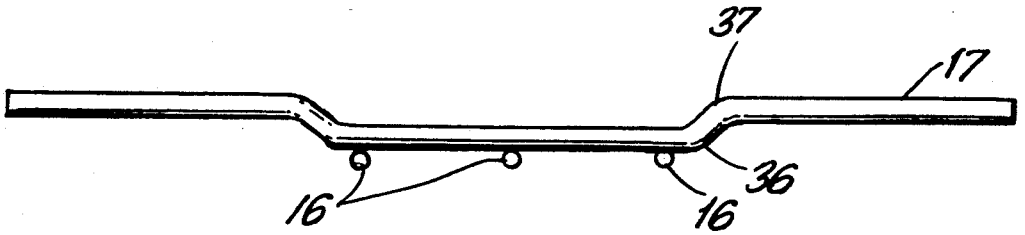
FIG. 5 is a detail of an offset mounting bar as used in the device of FIG. 4.

FIG. 4 illustrates a further device mounted in the same fashion as that of FIG. 3. Frame 13 surrounds a rack 36 having parallel members 34 with a connecting member 35. Suction cups 18 again are mounted on horizontal bars 17 in horizontally adjustable manner. The suction cup-bearing arms of bars 17 are offset or displaced into a plane behind the plane of frame 13 to provide clearance for mounting of suction cups 18. This feature is illustrated in FIG. 5 of the drawing wherein bar 17 is offset by bends 36 and 37. Rack 36 is bent into a generally U-shaped configuration and is useful for holding articles such as magazines, books, hair dryers, towels, toys, sponges, loofas, brushes, etc. at a convenience height and location.

Generally, the devices of the invention may be made from formed and welded steel wire covered with a protective coating such as polyethylene although some parts, such as soap dishes, shelf bottoms, etc. can be produced as molded plastic parts.

The devices offer the practical advantage that they can be located on a wall in a bathroom, shop, kitchen, workshop, laundry, etc., to hold a variety of articles in convenient reach. Another advantage is that the devices are removable and replaceable, thus permitting cleaning of the device and the wall behind it when indicated. This is in strong contrast to adhesively fastened devices.

Since considerable stress may be placed on the suction cup, the attachment thereto is a transverse hole in the boss on the back of the cup through which the horizontal bar 17 may be passed.

Many prior devices have used suction cups to prevent swinging of a caddy suspended from the shower pipe. In such cases the cup has merely been pressed around a wire on the caddy using a transverse slit in the boss or have been mounted on a post on the caddy extending in a direction perpendicular to the suction cup face. Such expedients offer little strength in tension and are insufficient by themselves to mount a caddy on a wall with any degree of reliability.

The devices provide convenience for storage and, at least in the case of the corner caddy, make a waste space useful.

What is claimed is:

1. A caddy device for installation on a non-porous wall comprising:

a frame having a horizontal arm element;

a plurality of members attached perpendicularly to said horizontal element;

a horizontal bar attached to said perpendicular members, with each end of said horizontal bar being open to receive a suction cup in slidable relation therewith; and connecting members fastened at each end to said frame to form a caddy device.

2. A caddy device in accordance with claim 1 comprising a corner shelf having a shelf member wherein said wire frame is bent in substantially the configuration of a right triangle with a plurality of said connecting members extending in parallel relation across said frame in a direction perpendicular to a line bisecting the right angle of said triangle to form a bearing surface for articles to be held on said shelf;

a wire gallery of congruent shape spaced apart from said shelf member and in a plane parallel thereto; with said perpendicular wire members fixedly connecting said shelf and said gallery in the arms thereof which form a right angle.

3. A shelf in accordance with claim 2 wherein said gallery subtends a substantially larger area than said shelf member.

4. A shelf in accordance with claim 2 wherein a plurality of said perpendicular wire members extends beneath said shelf and are formed into hook shape.

5. A shelf in accordance with claim 2 wherein said shelf frame member and said gallery have arms approaching at 90° but are open.

6. A shelf in accordance with claim 2 wherein the sides of said shelf member frame and said gallery opposite said 90° angle are curved in a direction away from said angle.

7. A shelf in accordance with claim 2 wherein the acute angles of said shelf member wire frame and said wire gallery are formed in a plurality of bends.

8. A shelf in accordance with claim 3 wherein said extending gallery forms a drying rack.

9. A caddy device in accordance with claim 1 wherein a plurality of said horizontal members are fastened one above the other to said perpendicular members;

said frame is bent to form downward extending portions and then outwardly to form horizontally extending arms perpendicular to said downwardly extending portions;

said downwardly extending portions of said frame are connected by said connecting members to form a grid structure;

said outwardly extending arms hold a rack and a soap dish therebetween; and a wire shelf fastened to said connecting members.

10. A caddy device in accordance with claim 9 wherein said perpendicular members extend below said shelf and support said soap dish.

11. A caddy device in accordance with claim 9 where said horizontally extending arms terminate in hooks.

12. A caddy device in accordance with claim 9 wherein said soap dish comprises a wire frame with parallel grid members forming an openwork bottom.

13. A caddy device in accordance with claim 9 wherein one of said perpendicular members extends below said shelf and terminates in a hook.

14. A caddy device in accordance with claim 9 wherein said frame is rectangular and said vertical members extend from said horizontal arm element to an opposing horizontal element to form a grid; and said grid is bent into a U-shape cross-section.

15. A caddy device in accordance with claim 9 wherein the arms of said U-shape are symmetrical.

* * * * *